US007979990B2

(12) United States Patent
Hawk et al.

(10) Patent No.: US 7,979,990 B2
(45) Date of Patent: Jul. 19, 2011

(54) SAFETY LOCK MECHANISM FOR FOLDING KNIVES

(75) Inventors: Grant W. Hawk, Idaho City, ID (US); Gavin D. Hawk, Idaho City, ID (US)

(73) Assignee: KAI U.S.A., Ltd., Tualatin, OR (US)

( * ) Notice: Subject to any disclaimer, the term of this patent is extended or adjusted under 35 U.S.C. 154(b) by 441 days.

(21) Appl. No.: 12/124,927

(22) Filed: May 21, 2008

(65) Prior Publication Data

US 2009/0288301 A1 Nov. 26, 2009

(51) Int. Cl.
*B26B 3/06* (2006.01)
*B26B 1/04* (2006.01)

(52) U.S. Cl. ..... 30/155; 30/160; 30/161

(58) Field of Classification Search ..... 30/151–164, 30/57, 527, 167, 169, 330, 337, 338, 1.5, 30/2

See application file for complete search history.

(56) References Cited

U.S. PATENT DOCUMENTS

| | | | | |
|---|---|---|---|---|
| 226,910 | A | 4/1880 | Friebertshauser | |
| 1,743,022 | A | 1/1930 | Carman | |
| 2,250,290 | A | 7/1941 | Berg | |
| 3,851,986 | A | 12/1974 | Daughtry | 403/373 |
| 3,868,774 | A | 3/1975 | Miori | 30/161 |
| 4,148,140 | A | 4/1979 | Lile | 30/161 |
| 4,451,982 | A | 6/1984 | Collins | 30/161 |
| 4,794,692 | A | 1/1989 | Wang | 30/123 |
| 4,854,045 | A | 8/1989 | Schaub | 30/155 |
| 4,893,409 | A | 1/1990 | Poehlmann | 30/161 |
| 4,974,323 | A * | 12/1990 | Cassady | 30/155 |
| 5,111,581 | A | 5/1992 | Collins | 30/161 |
| 5,325,588 | A * | 7/1994 | Rogers | 30/161 |
| 5,615,484 | A | 4/1997 | Pittman | 30/161 |
| 5,665,099 | A | 9/1997 | Pilo et al. | 606/167 |
| 5,737,841 | A | 4/1998 | McHenry et al. | 30/161 |
| 5,822,866 | A * | 10/1998 | Pardue | 30/161 |
| 5,839,194 | A | 11/1998 | Bezold | 30/161 |
| 5,964,036 | A | 10/1999 | Centofante | 30/161 |
| 6,122,829 | A | 9/2000 | McHenry et al. | 30/161 |
| 6,223,372 | B1 | 5/2001 | Barber | 7/118 |
| 6,338,431 | B1 | 1/2002 | Onion | 230/161 |
| 6,427,334 | B2 | 8/2002 | Onion | 30/161 |
| 6,427,335 | B1 * | 8/2002 | Ralph | 30/161 |
| 6,438,848 | B1 | 8/2002 | McHenry et al. | 30/161 |
| 6,481,034 | B2 | 11/2002 | Elsener et al. | 7/118 |
| 6,578,266 | B2 * | 6/2003 | Chomiak | 30/2 |
| 7,032,315 | B1 * | 4/2006 | Busse | 30/153 |
| 7,121,005 | B2 * | 10/2006 | Hughes | 30/158 |
| 7,278,213 | B2 * | 10/2007 | Pardue et al. | 30/160 |
| 7,284,329 | B1 | 10/2007 | King | 30/161 |

(Continued)

*Primary Examiner* — Boyer D. Ashley
*Assistant Examiner* — Omar Flores-Sánchez
(74) *Attorney, Agent, or Firm* — Seed IP Law Group PLLC

(57) ABSTRACT

A safety lock mechanism for a folding knife includes a lock plate movably coupled to a handle of the knife for movement along a first direction from an engaged position to a disengaged position, the lock plate biased towards the engaged position. A rocker element is coupled to the lock plate for movement from a locked position to an unlocked position and is configured to prevent translational movement of the lock plate to the disengaged position when the rocker element is in the locked position. A control button coupled to the rocker element allows a user to move the rocker element from the locked position to the unlocked position and to move the lock plate towards the disengaged position to thereby release a blade of the knife.

19 Claims, 4 Drawing Sheets

U.S. PATENT DOCUMENTS

| | | | | |
|---|---|---|---|---|
| 7,313,866 | B2 * | 1/2008 | Linn et al. | 30/159 |
| 7,536,788 | B2 * | 5/2009 | VanHoy et al. | 30/154 |
| 7,698,821 | B2 * | 4/2010 | Ralph | 30/160 |
| 2007/0169354 | A1 * | 7/2007 | Ralph | 30/160 |
| 2007/0180702 | A1 | 8/2007 | Hawk et al. | 30/161 |
| 2007/0256304 | A1 | 11/2007 | Pardue et al. | 30/160 |
| 2008/0201953 | A1 | 8/2008 | Bremer et al. | 30/1 |

* cited by examiner

SAFETY LOCK MECHANISM FOR FOLDING KNIVES

BACKGROUND

1. Technical Field

This disclosure generally relates to folding knives, and in particular to folding knives having safety lock mechanisms.

2. Description of the Related Art

Folding knives enjoy wide popularity, particularly among sportsmen, campers, hikers, and many others engaged in outdoor activities. Common elements to folding knives include a handle and a blade pivotally connected to an end of the handle so that the blade pivots with respect to the handle between an open position in which the blade is extended away from the handle, and a closed position in which the blade is at least partially received within the handle. Many folding knives also include a locking mechanism to maintain the blade in the open position and/or the closed position. A locking mechanism is particularly advantageous with folding knives having an assisted opening mechanism and automatic knives. Examples of folding knives, including folding knives with locking mechanisms, may be found in U.S. Patent Publication No. 2007/0180702, the entire disclosure of which is herein incorporated by reference for all purposes.

One difficulty that has been encountered is that the locking mechanism of many knives is prone to inadvertent disengagement of the lock which can lead to unintended deployment of the knife blade from a closed position or unintended closure from an open position. Such unintended deployment and closure of the knife blade presents a safety hazard to users, particularly in the case of an automatic knife (i.e., switchblade) or a knife having an assisted opening mechanism.

BRIEF SUMMARY

According to various embodiments, a safety lock mechanism of a folding knife effectively prevents unintended movement of a knife blade from a closed or open position. According to one embodiment, the safety lock mechanism has a lock plate movably coupled to a handle of a knife for movement along a first direction from an engaged position to a disengaged position, the lock plate biased towards the engaged position. A rocker element is movably coupled to the lock plate for movement from a locked position to an unlocked position and is configured to prevent translation of the lock plate to the disengaged position while in the locked position.

A detent mechanism is configured to cooperate with the rocker element to bias the rocker element toward the locked position and unlocked position while the rocker element is in the locked position and unlocked position, respectively.

A control button coupled to the rocker element and accessible to a user at an outer side of the handle permits the user to move the rocker element to the unlocked position and the lock plate to the disengaged position to thereby release a blade of the knife.

DETAILED DESCRIPTION

Figure 1:
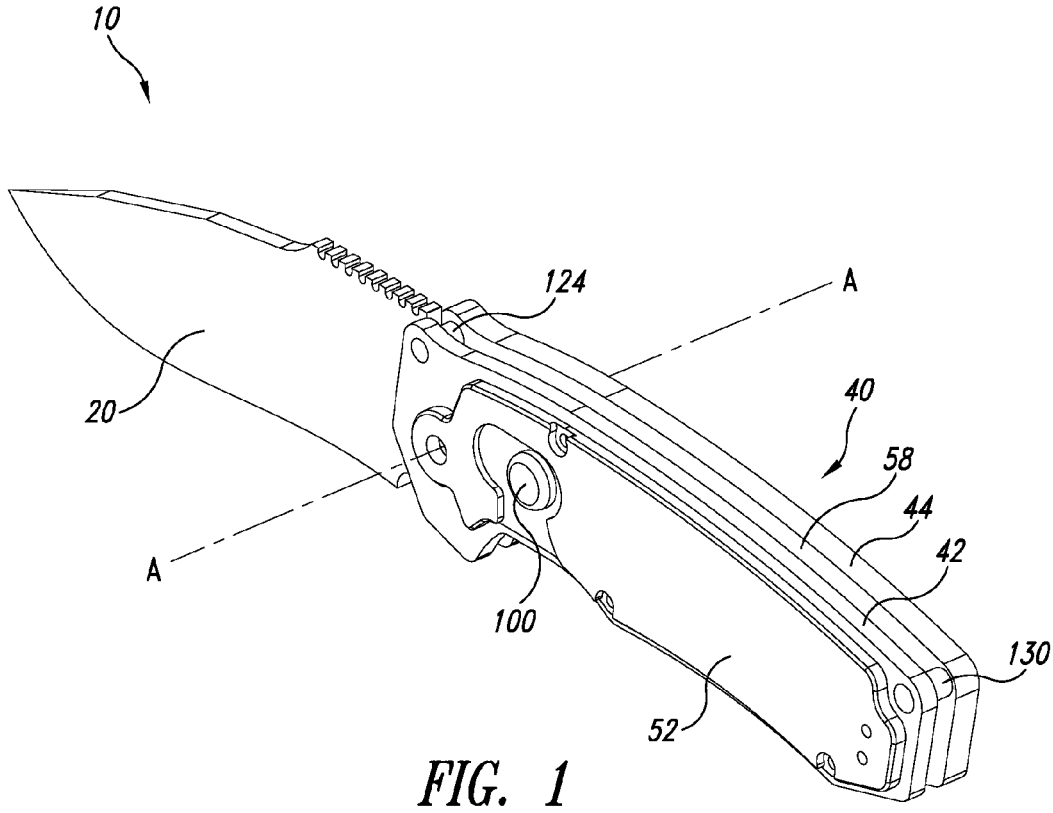
FIG. 1 is a perspective view of a folding knife according to one embodiment.
Figure 2:
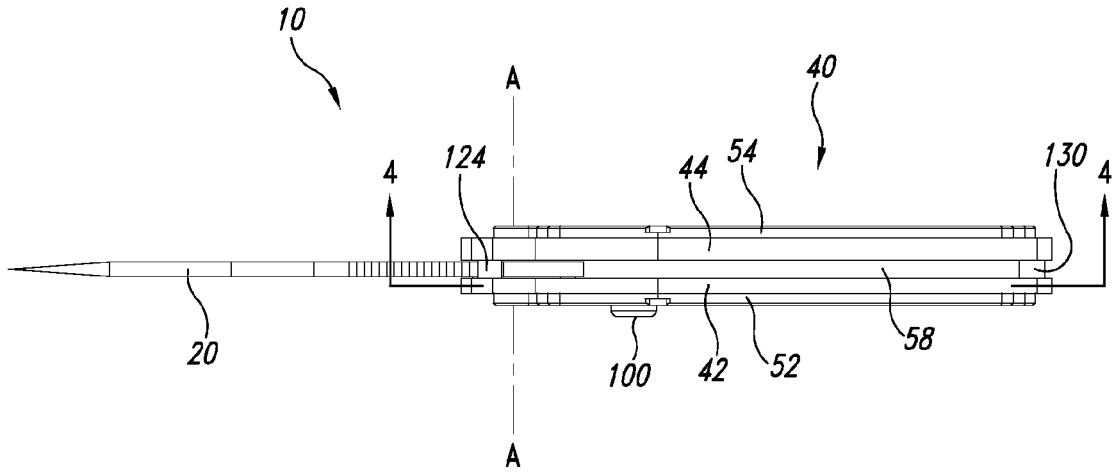
FIG. 2 is a top plan view of the knife of FIG. 1.

For the purposes of clarity and ease of comprehension, directional terms such as, for example, top, bottom, right, and left may be used in describing embodiments, and will be with reference to elements as they appear on the figures. Where elements are described using terms such as inner or outer, this is with respect to a central plane of the knife, i.e., a plane that lies parallel to, and substantially centered between, the first and second frame members. Thus, a side of an element that lies closer to that center plane than another side of the element may be described as the inner side of the element.

Elements that are, in the illustrated embodiment, substantially identical will be identified by identical reference numbers. Where it is necessary to distinguish between such identical elements in the description, letters will be used. Fasteners, which may be screws, rivets, pins, or other suitable devices such as are well known in the art, are not illustrated for purposes of clarity and ease of comprehension.

An embodiment will be described with reference to FIGS. 1-7.

The knife 10 includes a handle 40 and a blade 20. The handle 40 includes first and second frame members 42, 44 arranged in a spaced-apart relationship, with a space, or blade channel 58, between them. First and second handle overlays 52, 54 are affixed to outer faces of the first and second frame members 42, 44, respectively, by fasteners (not shown). A spacer 130 is positioned between the first and second frame members 42, 44 at a rear end of the handle 40. A stop pin 124 is positioned between the first and second frame members 42, 44 at a front end of the handle 40.

Figure 4:
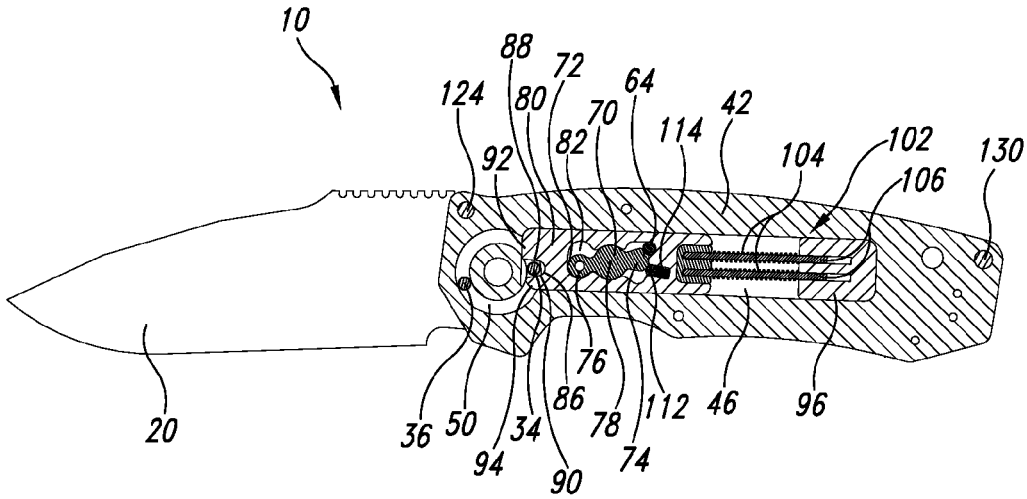
FIG. 4 shows a cross-sectional view of the knife of FIG. 2 taken along line 4-4, with the knife in an open locked position.
Figure 5:
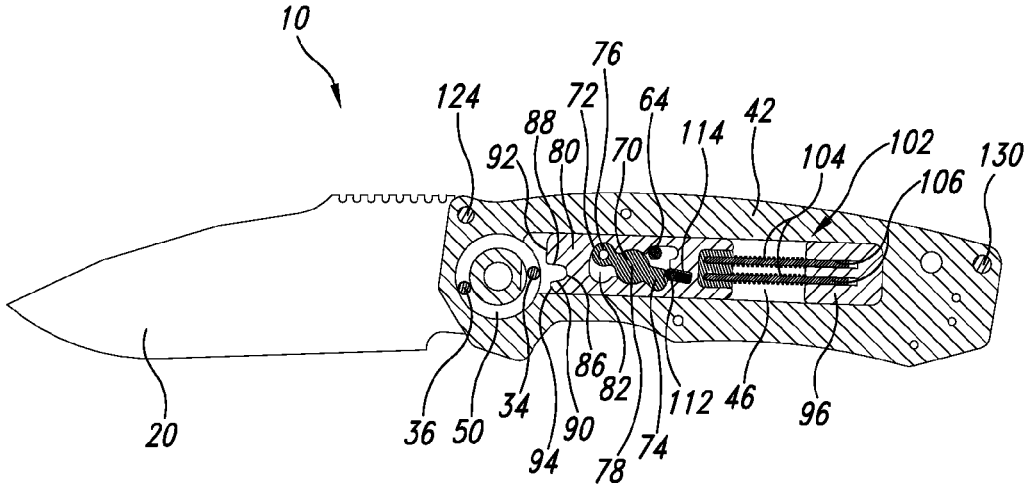
FIG. 5 shows a cross-sectional view of the knife of FIG. 2 taken along line 4-4, with the knife in an open unlocked position.
Figure 6:
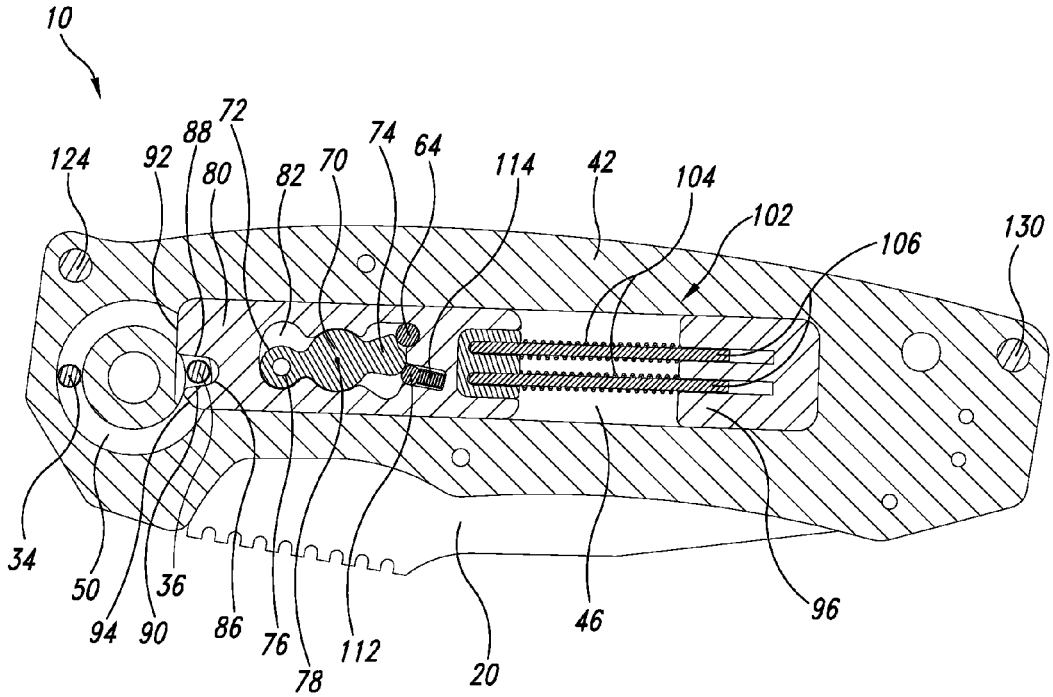
FIG. 6 shows a cross sectional view of the knife of FIG. 2 taken along line 4-4, with the knife in a closed locked position.
Figure 7:
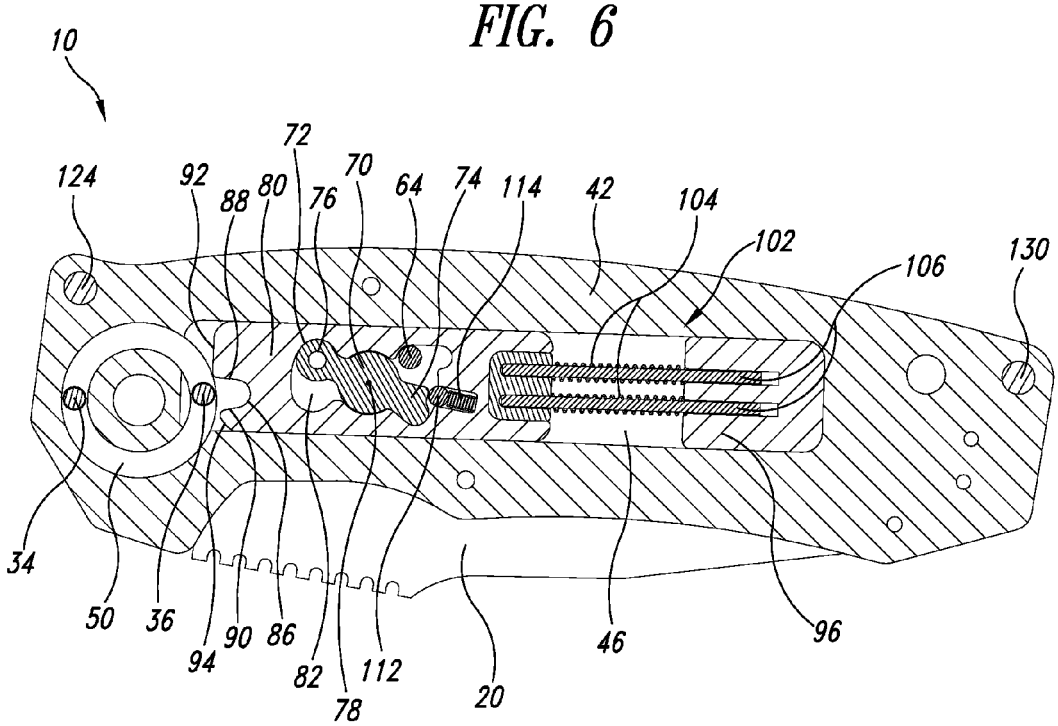
FIG. 7 shows a cross sectional view of the knife of FIG. 2 taken along line 4-4, with the knife in a closed unlocked position.

The blade 20 is coupled to the handle 40 so as to rotate around a pivot axis A with respect to the handle 40, between an open position, as shown in FIGS. 1, 2, 4 and 5, in which the sharp edge of the blade 20 is exposed, and a closed position, as shown, for example, in FIGS. 6 and 7, in which the blade lies with the sharp edge within the channel 58, between the first and second frame members 42, 44. In other embodiments, the blade 20 may be positioned in the blade channel 58 to a greater or lesser degree than that shown in the pictured embodiment. The blade 20 includes a blade pivot aperture 22 formed coaxially with the pivot axis A, and control apertures 24, 26 positioned some distance from the pivot axis A. The pivot aperture 22 and the control apertures 24, 26 traverse the blade 20. First and second control pins 34, 36 are positioned in the control apertures 24, 26, respectively.

Frame pivot apertures 48 are provided in each of the first and second handle frame members 42, 44, and each of the first and second handle overlays 52, 54 is provided with an overlay pivot aperture 56. The pivot apertures 48 and 56 are positioned so as to be substantially coaxial with the pivot axis A when the knife 10 is properly assembled.

A safety lock mechanism 60 is provided to retain the blade 20 in the open and closed positions and prevent inadvertent blade movement. The safety lock mechanism 60 includes a lock plate 80 having a notch 86, with first and second sides 88, 90, and positioned, in the pictured embodiment, in a lock cavity 46 formed in the first frame member 42. The lock cavity 46 is sized to permit translational movement of the lock plate 80, and biasing means 102 are provided to bias the lock plate 80 substantially toward the pivot axis A. In the pictured embodiment, the bias means 102 comprise springs 104 and guide rods 106, but a wide variety of mechanisms may be employed as biasing means, and substituted for the springs, such as, for example, flexible rods, leaf springs, torsion springs, etc. The bias means may be retained within a separate retaining structure, such as, for example a guide plate 96, or alternatively, may be retained within a cavity, groove, or the like, formed in the first handle frame member 42.

The safety lock mechanism 60 further includes a rocker element 70 movably coupled to the lock plate 80 for movement between a locked position and an unlocked position. In the illustrated embodiment, the rocker element 70 has first and second ends 72, 74 and is positioned in an aperture 82 of the lock plate 80. The aperture 82 is sized and shaped to substantially prevent relative translational movement between the lock plate 80 and rocker element 70 in a direction substantially parallel to the direction of travel of the lock plate 80 and to simultaneously allow relative rotational movement therebetween. The rocker element 70 is allowed to rotate about an axis passing through a center portion of the rocker element 70, the location of the axis corresponding to the center 78 of circular arc segments of the rocker element 70. Although the present embodiment illustrates the rocker element 70 movably coupled to the lock plate 80 for rotational movement therebetween, other forms of movably coupling the rocker element 70 to the lock plate 80 are feasible. For example, in an alternate embodiment, the rocker element 70 may be movably coupled to the lock plate 80 to allow relative translational movement therebetween in a direction substantially perpendicular to the direction of travel of the lock plate 80.

The first end 72 of the rocker element 70 is coupled to a control button 100 via a control button aperture 76 for manually moving the rocker element 70 from a locked position to an unlocked position. The second end 74 of the rocker element 70 cooperates with a detent mechanism 110 to selectively hold the rocker element 70 in the locked and unlocked positions. In the illustrated embodiment, the detent mechanism 110 comprises a detent ball 112 and a detent spring 114 retained in a channel of the lock plate 80, but a wide variety of detent mechanisms may be employed, and substituted for the detent ball and spring, such as, for example, a spring steel lever and notches.

Figure 3:
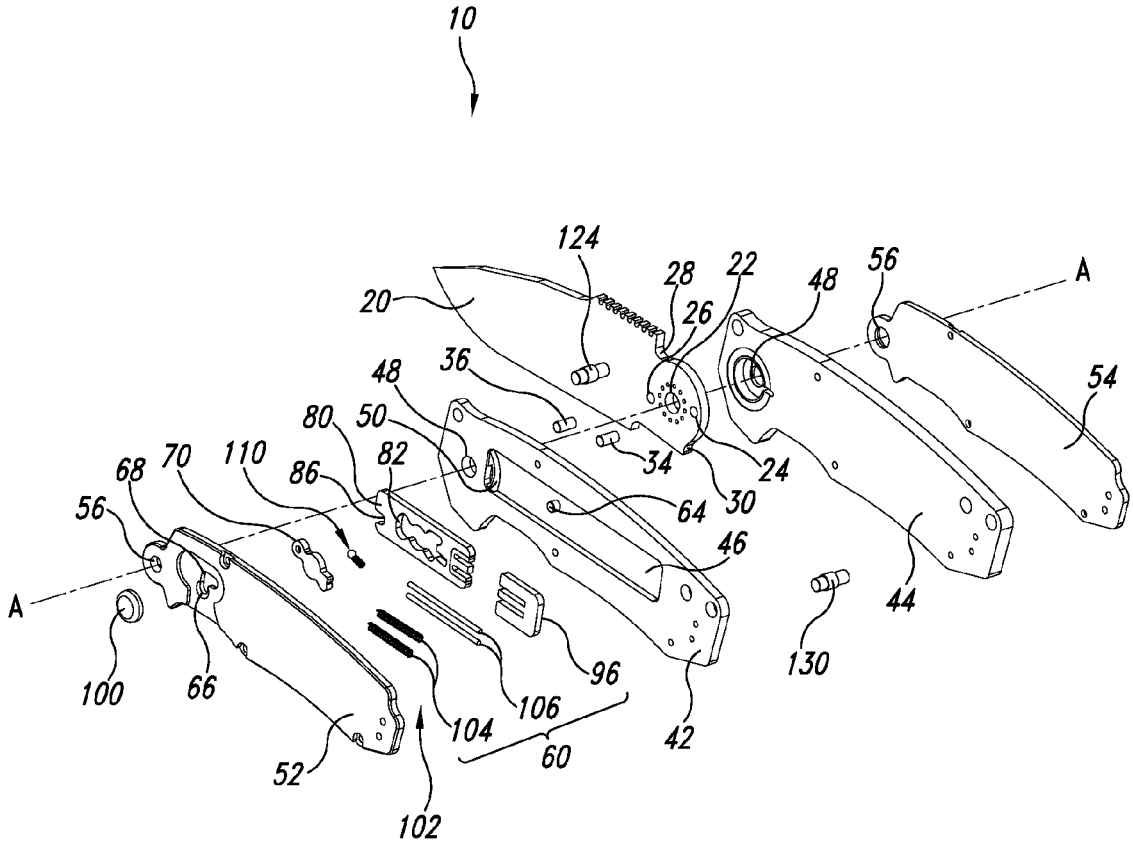
FIG. 3 shows the knife of FIG. 1 in an exploded view.

Operation of the safety lock mechanism 60 will be described with reference, in particular, to FIGS. 4 through 7. The first frame member 42 is provided with an arcuate pin race 50 formed in the inner face of the first frame member 42 that is positioned coaxially with the pivot axis A. The pin race 50 and the lock cavity 46 are formed in opposite faces of the frame member 42, but are of depths such that they intersect in an area where they overlap, as can be seen in FIG. 3, where a portion of the race 50 is visible inside the lock cavity 46. At the location where they overlap, the pin race 50 forms an aperture through the frame member 42. The cross-section of FIGS. 4 through 7 is taken through the first frame member 42 at a depth that shows both the lock cavity 46 and the pin race 50.

As previously described, the blade 20 is provided with control apertures 24, 26. First and second control pins 34, 36 are positioned in respective control apertures 24, 26, and extend from the blade 20 into the pin race 50. As the blade 20 rotates between the open and closed position, the control pins 34, 36 slide within the pin race 50 in an arc around the pivot axis A. In this embodiment, the pin race 50 forms a complete path around the frame pivot aperture 48. Rotational travel of the blade 20 is limited by a first blade stop 28 and a second blade stop 30 that are positioned to engage a stop pin 124 that is coupled between the first and second frame members 42, 44 when the knife is in the open and closed position, respectively. In an alternate embodiment, the pin race 50 forms a partial path having first and second ends that serve as rotation stops to limit movement of the blade 20 to an arc of travel between the open and closed position.

FIG. 4, which shows the knife 10 with the blade 20 in the open position, shows the notch 86 of the lock plate 80 in engagement with the first control pin 34. The lock plate 80 is pressed into engagement with first control pin 34 by springs 104. It can be seen that, as viewed in FIG. 4, the first control pin 34 must rotate in a counterclockwise direction around the pivot axis A when the blade 20 is moved from the open position toward the closed position. The first side 88 of the notch 86 is shaped such that, while the lock plate 80 is in an engaged position in which the notch 86 is engaged with the first control pin 34, it will prevent movement of the blade 20 toward the closed position. Rotational force applied to the blade 20 is transferred to the first control pin 34, and thence to the lock plate 80 at a vector that is nearly perpendicular to the direction of movement of the lock plate 80. Thus, the lock plate 80 binds against the side of the lock cavity 46 and does not permit passage of the first control pin 34. In another embodiment, the first side 88 of the notch lock plate is configured to act as a detent, allowing the blade to be moved away from the open position when sufficient force toward the closed position is applied to the blade 20. The shape of the first side 90 and the biasing force of the springs 104 can be selected to control the degree of force necessary to overcome the resistance of the lock plate 80 to move blade 20.

As shown in FIG. 4, the lock plate 80 is held in the engaged position by springs 104 and prevented from translating to a disengaged position by the rocker element 70 when the rocker element 70 is rotated to a locked position. The lock plate 80 is prevented from translating to the disengaged position by an island stop 64 that is positioned in the lock cavity 46 of the first frame member 42 and configured to cooperate with the second end 74 of the rocker element 70. The island stop 64 may be integral with the first frame member 42, such as, for example, leaving material in place when milling the lock cavity 46, or may be coupled to the first frame member 42, such as, for example by fastening, welding, etc. It may also be a pin that is pressed into a recess in the frame member 42 and extends out as shown in FIG. 3. Conversely, when the rocker element 70 is in an unlocked position, as shown in FIG. 5, the lock plate 80 is able to translate away from the pivot axis A towards the disengaged position.

In order to move the blade 20 away from the open position, it is necessary that the rocker element 70 be manually moved to the unlocked position and the lock plate 80 be moved from the engaged position, as shown in FIG. 4, to the disengaged position, as shown in FIG. 5, wherein the notch 86 of the lock plate 80 is out of engagement with the first control pin 34. A user does this by first moving the control button 100 in a direction toward the back of the knife. To move the rocker element 70 to the unlocked position, the user applies a force to the control button 100 sufficient to overcome a first bias applied to the rocker element 70 by the detent mechanism 110. Once in the unlocked position, the rocker element 70 is held in place by a second bias applied to the rocker element 70 by the detent mechanism 110. With the rocker element 70 no longer in contact with the island stop 64, the lock plate is unlocked. In the unlocked position, the lock plate 80 is able to move in a direction away from the pivot axis A, thereby allowing the blade 20 to move away from the open position.

When the blade 20 is moved into the fully open position from being closed, the first control pin 34 approaches engagement with the lock plate 80, and pushes against an end face 92 of the lock plate 80, applying force at a vector that easily moves the lock plate 80 rightward a distance sufficient to permit passage of the first control pin 34. Thus, as configured in the present embodiment, the blade 20 moves easily into the fully open position and is locked there until it is manually released for movement toward the closed position. Once the blade 20 is in the open position, the rocker element 70 may be manually moved to the locked position by moving the control button 100 in a direction away from the back of the knife, thereby preventing inadvertent displacement of the lock plate 80 and closure of the blade 20. To move the rocker element 70 to the locked position, the user applies a force to the control button 100 sufficient to overcome the second bias applied to the rocker element 70 by the detent mechanism 110.

In one embodiment, the first blade stop 28 of the blade 20 defines the limit of travel of the blade 20 in the clockwise direction. When the blade is moved to the open position, the first blade stop 28 makes contact with the stop pin 124, which prevents further movement. The notch 86 of the lock plate 80 has a location and shape such that the first side 88 of the notch 86 engages the first control pin 34 before the lock plate 80 reaches the leftmost end of the lock cavity 46. This allows the lock plate 80, in engagement with the first control pin 34, to cooperate with the first blade stop 28 of the blade 20, in engagement with the stop pin 124, to provide a solid lock to the blade 20, substantially without play.

FIG. 6, which shows the knife 10 with the blade 20 in the closed position, shows the notch 86 of the lock plate 80 in engagement with the second control pin 36 and shows the rocker element 70 in the locked position. The lock plate 80 is pressed into engagement with the second control pin 36 by springs 104. It can be seen that, as viewed in FIG. 6, the second control pin 36 must rotate in a clockwise direction around the pivot axis A when the blade 20 is moved from the closed position toward the open position.

In order to move the blade 20 away from the closed position, it is necessary that the rocker element 70 be manually moved to the unlocked position and the lock plate 80 be moved from the engaged position, as shown in FIG. 6, to the disengaged position, as shown in FIG. 7, wherein the notch 86 of the lock plate 80 is out of engagement with the second control pin 36. A user does this by first moving the control button 100 in a direction toward the back of the knife. As previously described, to move the rocker element 70 to the unlocked position, the user applies a force to the control button 100 sufficient to overcome a first bias applied to the rocker element 70 by the detent mechanism 110. Once in the unlocked position, the rocker element 70 is held in place by a second bias applied to the rocker element 70 by the detent mechanism 110. In the unlocked position, the lock plate 80 is able to move in a direction away from the pivot axis A, thereby allowing the blade 20 to move away from the closed position.

On the other hand, when the blade 20 is moved into the closed position, the second control pin 36 approaches engagement with the lock plate 80, and pushes against a sloped surface 94 of the lock plate 80, applying force at a vector that easily moves the lock plate 80 rightward a distance sufficient to permit passage of the second control pin 36. Thus, as configured in the present embodiment, the blade 20 moves easily into the fully closed position and is locked there until it is manually released for movement toward the open position. Once the blade 20 is in the closed position, the rocker element 70 may be manually moved to the locked position by moving the control button 100 in a direction away from the back of the knife, thereby preventing inadvertent displacement of the lock plate 80 and deployment of the blade 20. As previously described, in order to move the rocker element 70 to the locked position, the user must apply a force to the control button 100 sufficient to overcome the second bias applied to the rocker element 70 by the detent mechanism 110.

In one embodiment, the second side 90 of the notch 86 is shaped such that the lock plate 80 will resist movement of the blade 20 toward the open position until the lock plate 80 is manually moved out of engagement with the second control pin 36, in a manner similar to that described above with reference to the first side 88. Such an embodiment is particularly beneficial for a switchblade or automatic type knife that is spring biased to open quickly when the second lock plate 80 is translated to the disengaged position.

In another embodiment, the shape of the second side 90 is selected such that when sufficient rotational force is applied to the blade 20, the second control pin 36 pressing against the second side 90 of the notch 86 will drive the lock plate 80 in a rightward direction against the biasing force applied by the springs 104, thereby releasing the blade 20 to move toward the open position. Thus, the safety lock mechanism 60 acts as a detent mechanism to releasably hold the blade in the closed position. The shape of the second side 90 and the biasing force of the springs 104 can be selected to control the degree of force necessary to overcome the resistance of the lock plate 80 to move blade 20.

According to one embodiment, the required biasing force is selected such that, in normal operation, when a user applies a force sufficient to overcome the resistance of the lock plate 80, the same force is sufficient to move the blade 20 all the way to the open position. The force applied to start movement of the blade 20 from the closed position toward the open position will cause the blade 20 to complete the movement without further effort. Thus, a user may press against a thumb stud or some other feature of the blade (not shown) until the blade 20 begins to move, and the blade will thereafter complete the movement independently.

An example of a suitable blade feature against which a user may press to open the blade 20 is an element sometimes referred to as a flipper. This is an enlarged portion of the blade that extends from a back part of the blade 20 when the blade 20 is in the closed position, such that pressure against the enlarged portion will move the blade 20 away from the closed position. A number of terms are used in the art to refer to this enlarged portion, including flipper, trigger, kicker, ridge, etc. One example of such a feature is described in U.S. Pat. No. 6,338,431, which is incorporated herein by reference, in its entirety.

In some embodiments, an indicator 66 is provided on the handle 40 to visually indicate when the rocker element 70 is in the locked or unlocked position. For example, in one embodiment, the indicator 66 is a red arcuate region provided around a button aperture 68 of the first handle overlay 52, as can be seen in FIG. 3.

Some embodiments do not include all the elements of the disclosed embodiments, and some combine elements disclosed here with more conventional aspects. For example, in the embodiment shown, the blade channel 58 extends through the knife 10, from the back side to the front side, with only the blade 20, spacer pin 130, and the stop pin 124 positioned between the first and second frame members 42, 44. Such an arrangement is not essential. Other embodiments may include a channel that is open only at the front of the knife.

Some of the features of the embodiments disclosed above are grouped into elements and sub-elements for convenience. For example, a safety lock mechanism is described as including a number of individual components. Where claims recite similar elements, such claims should not be construed as including the same sub-elements unless the sub-elements are explicitly recited as members of the recited elements.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A safety lock mechanism for a folding knife, comprising:

a lock plate movably coupled to a handle of the knife for movement along a first direction from an engaged position to a disengaged position, the lock plate biased towards the engaged position;

a rocker element, the rocker element movably coupled to the lock plate for movement from a locked position to an unlocked position and configured to prevent translation of the lock plate to the disengaged position while in the locked position;

a first control pin coupled to a blade of the knife, the first control pin positioned for engagement by a notch of the lock plate when the blade is in an open position and the lock plate is in the engaged position; and a second control pin coupled to the blade, the second control pin positioned for engagement by the notch of the lock plate when the blade is in a closed position and the lock plate is in the engaged position.

2. The safety lock mechanism of claim 1, further comprising:

a detent mechanism, the detent mechanism configured to cooperate with the rocker element to bias the rocker element toward the locked position and unlocked position while the rocker element is in the locked position and unlocked position, respectively.

3. The safety lock mechanism of claim 2 wherein the detent mechanism includes a detent ball and detent spring, the detent ball engaged by the detent spring and positioned in contact with an end of the rocker element.

4. The safety lock mechanism of claim 1, further comprising:

a control button coupled to the rocker element, the control button accessible to a user at an outer side of the handle and configured to move the rocker element between the locked position and the unlocked position via movement of the control button.

5. The safety lock mechanism of claim 1 wherein the lock plate includes an aperture, the aperture configured to retain the rocker element so as to substantially prevent relative translational movement between the lock plate and rocker element in the first direction and to simultaneously allow relative rotational movement therebetween.

6. A folding knife, comprising:

a handle having a pivot aperture, the pivot aperture having a pivot axis;

a blade coupled to the handle and configured to rotate about the pivot axis between a closed position and an open position;

a safety lock mechanism coupled to the handle, the safety lock mechanism having a lock plate and a rocker element, the lock plate movable along a first direction from an engaged position to a disengaged position, the rocker element movable from a locked position to an unlocked position, and the safety lock mechanism configured to prevent translation of the lock plate to the disengaged position while the rocker element is in the locked position thereby preventing rotation of the blade away from the closed and open positions while the blade is in the closed and open positions, respectively;

a first control pin coupled to the blade, the first control pin positioned for engagement by a notch of the lock plate when the blade is in the open position and the lock plate is in the engaged position; and a second control pin coupled to the blade, the second control pin positioned for engagement by the notch of the lock plate when the blade is in the closed position and the lock plate is in the engaged position.

7. The folding knife of claim 6, further comprising, a detent mechanism, the detent mechanism configured to cooperate with the rocker element to bias the rocker element toward the locked position and unlocked position while the rocker element is in the locked position and unlocked position, respectively.

8. The folding knife of claim 6, further comprising:

a control button coupled to the rocker element, the control button accessible to a user at an outer side of the handle and configured to move the rocker element between the locked position and the unlocked position via movement of the control button.

9. The folding knife of claim 6 wherein the lock plate includes an aperture, the aperture configured to retain the rocker element so as to substantially prevent relative translational movement between the lock plate and rocker element in the first direction.

10. The folding knife of claim 6 wherein the notch includes a first side and a second side, the first side configured to prevent the blade from closing while the blade is in the open position until the lock plate is moved away from the engaged position, and the second side configured to prevent the blade from opening while in the closed position until the lock plate is moved away from the engaged position.

11. The folding knife of claim 6 wherein the lock plate includes a surface configured to cooperate with the second control pin to temporarily displace the lock plate from the engaged position toward the disengaged position when the blade nears the closed position.

12. The folding knife of claim 6 wherein the handle includes an island stop positioned to cooperate with the rocker element when the rocker element is in the locked position to prevent translation of the lock plate away from the engaged position.

13. A folding knife, comprising:

a handle having a first handle element and a second handle element;

a blade positioned between the first and second handle elements and configured to rotate about a pivot axis between a closed position and an open position;

a safety lock mechanism retained in the first handle element, the safety lock mechanism having a lock plate and a rocker element, the lock plate movable along a first direction from an engaged position to a disengaged position, the rocker element movable from a locked position to an unlocked position, and the safety lock mechanism configured to prevent translation of the lock plate to the disengaged position when the rocker element is in the locked position;

a first control pin coupled to the blade, the first control pin positioned for engagement by a notch of the lock plate when the blade is in the open position and the lock plate is in the engaged position;

a second control pin coupled to the blade, the second control pin positioned for engagement by the notch of the lock plate when the blade is in the closed position and the lock plate is in the engaged position; and bias means adapted to bias the lock plate towards the engaged position.

14. The folding knife of claim 13 wherein the bias means includes at least one spring and at least one guide rod.

15. The folding knife of claim 13 wherein the first handle element includes a lock recess, the lock recess having a size and shape sufficient to retain the safety lock mechanism and bias means.

16. The folding knife of claim 15, further comprising:

an island stop positioned within the lock recess to cooperate with the safety lock mechanism so as to substantially prevent translational movement of the lock plate while the rocker element is in the locked position.

17. The folding knife of claim 16 wherein the island stop is integral with the first handle element.

18. The folding knife of claim 16 wherein the island stop is coupled to the first handle element.

19. The folding knife of claim 13, further comprising:

at least one handle overlay, the at least one handle overlay positioned on an outer side of the first handle element to enclose the safety lock mechanism between the first handle element and the at least one overlay.

* * * * *